US009074436B2

(12) United States Patent
Runia et al.

(10) Patent No.: US 9,074,436 B2
(45) Date of Patent: Jul. 7, 2015

(54) METHODS FOR INSTALLING SENSORS IN A BOREHOLE

(75) Inventors: Douwe Johannes Runia, Rijswijk (NL); Robert Nicholas Worrall, Naples, FL (US)

(73) Assignee: Schlumberger Technology Corporation, Sugar Land, TX (US)

( * ) Notice: Subject to any disclaimer, the term of this patent is extended or adjusted under 35 U.S.C. 154(b) by 916 days.

(21) Appl. No.: 13/124,067

(22) PCT Filed: Oct. 15, 2009

(86) PCT No.: PCT/EP2009/063516
§ 371 (c)(1),
(2), (4) Date: Jun. 29, 2011

(87) PCT Pub. No.: WO2010/043690
PCT Pub. Date: Apr. 22, 2010

(65) Prior Publication Data

US 2011/0315445 A1 Dec. 29, 2011

(30) Foreign Application Priority Data

Oct. 16, 2008 (GB) ..... 0818902.9

(51) Int. Cl.
*E21B 47/00* (2012.01)
*E21B 47/12* (2012.01)
(Continued)

(52) U.S. Cl.
CPC ..... *E21B 10/62* (2013.01); *E21B 19/16* (2013.01); *E21B 47/00* (2013.01); *E21B 47/0001* (2013.01); *E21B 47/12* (2013.01)

(58) Field of Classification Search
CPC ..... E21B 47/00; E21B 10/62; E21B 47/0001; E21B 47/12
USPC ..... 175/50
See application file for complete search history.

(56) References Cited

U.S. PATENT DOCUMENTS 5,206,840 A * 4/1993 Cobbs et al. ..... 367/178
5,339,679 A 8/1994 Ingram et al.
(Continued)

FOREIGN PATENT DOCUMENTS

GB 1433265 A 4/1976
WO 0017488 A1 3/2000
(Continued)

OTHER PUBLICATIONS

Matula, Chuck, "Lower Risk by Logging Through the Bit," retrieved Mar. 16, 2009 from http://www.epmag.com/article/print/28634 (Jan. 29, 2009), pp. 1-2.
(Continued)

*Primary Examiner* — Nicole Coy
*Assistant Examiner* — Kristyn Hall
(74) *Attorney, Agent, or Firm* — Fletcher Yoder, P.C.

(57) ABSTRACT

A method of installing a sensor in a borehole drilled through underground formations, wherein the borehole is drilled with a hollow drill string formed from a series of pipe sections connected end-to-end, a drill bit being positioned at one end of the drill string and having a closure member that provides an opening between the borehole and the inside of the drill string, the method comprising:
drilling the borehole to a predetermined;
partially withdrawing the drill string from the borehole so that the drill bit is positioned above the predetermined depth;
lowering a sensor inside the drill string by means of a cable;
operating the closure so that the sensor can pass out of the drill string into the borehole; and
progressively withdrawing the drill string and drill bit from the borehole over the cable so as to leave the sensor in the borehole.

16 Claims, 8 Drawing Sheets

(51) Int. Cl.
*E21B 10/62* (2006.01)
*E21B 19/16* (2006.01)

(56) References Cited

U.S. PATENT DOCUMENTS

| | | | | |
|---|---|---|---|---|
| 5,467,823 | A * | 11/1995 | Babour et al. | 166/250.01 |
| 5,553,677 | A | 9/1996 | Hinz | |
| 6,230,800 | B1 * | 5/2001 | Bryant | 166/250.01 |
| 7,287,609 | B2 * | 10/2007 | Runia et al. | 175/257 |
| 2003/0218937 | A1 * | 11/2003 | Berg et al. | 367/16 |
| 2004/0020653 | A1 * | 2/2004 | Smith | 166/336 |
| 2004/0118611 | A1 | 6/2004 | Runia et al. | |
| 2004/0238218 | A1 | 12/2004 | Runia et al. | |
| 2004/0238224 | A1 | 12/2004 | Runia | |
| 2007/0114062 | A1 * | 5/2007 | Hall et al. | 175/50 |
| 2007/0188344 | A1 * | 8/2007 | Hache et al. | 340/853.1 |
| 2008/0173481 | A1 * | 7/2008 | Menezes et al. | 175/40 |
| 2008/0265896 | A1 * | 10/2008 | Strack et al. | 324/350 |

FOREIGN PATENT DOCUMENTS

| | | | |
|---|---|---|---|
| WO | 0060212 | A1 | 10/2000 |
| WO | 03008754 | A1 | 1/2003 |
| WO | 2004046505 | A2 | 6/2004 |

OTHER PUBLICATIONS

Mahony, James, "Through-Bit Technology May Brighten the Outlook for Tough Logging Conditions," New Technology Magazine (Sep. 2004), pp. 1-3.

Corporate Brochure retrieved Aug. 9, 2012 from www.ThruBit.com. "ThruBit Logging Solutions," pp. 1-4.

Runia, John, et al., "Technologies Leading Way to New Through-Bit, Through-Bore Capabilities in Well Logging and Drilling," The American Oil and Gas Reporter, pp. 68-77.

Boyes, et al., "Through Bit Logging: A New Method to Acquire Log Data," (Abstract) Petrophysics, vol. 46, No. 4, Jul.-Aug. 2005 (1 p.).

Runia, et al., "Through Bit Logging: Applications in Difficult Wells, Offshore North Sea," SPE/IADC 92256 Drilling Conference, Amsterdam, The Netherlands, Feb. 23-25, 2005 (8 p.).

PCT/EP2009/063516 International Search Report, Mar. 25, 2010 (4 p.).

Runia, John, et al., "Through Bit Logging: A New Method to Acquire Log Data, and a First Step on the Road to Through Bore Drilling, "SPWLA 45th Annual Logging Symposium, Jun. 6-9, 2004 (8 p.).

* cited by examiner

METHODS FOR INSTALLING SENSORS IN A BOREHOLE

CROSS-REFERENCE TO RELATED APPLICATIONS

This application is a 35 U.S.C. §371 national stage application of PCT/EP2009/063516 filed Oct. 15, 2009, which claims the benefit of British Application No. 0818902.9 filed Oct. 16, 2008, both of which are incorporated herein by reference in their entireties for all purposes.

TECHNICAL FIELD

This invention relates to methods for installing sensors in boreholes. In particular, the invention relates to methods for installing sensors through the drill string being used to drill the borehole.

BACKGROUND ART

In order to perform long-term monitoring of underground formations, such as reservoirs in the oil and gas industry, it has been proposed to install sensors in boreholes drilled in and around the formations of interest. A typical system for drilling the boreholes comprises a hollow drill string formed from pipes connected end-to-end, and a drill bit positioned on the lower end of the drill string. The presence of the drill bit has meant that it is not possible to easily obtain access to the borehole for sensors from the inside of the drill string. It is usually necessary to completely withdraw the drill string from the borehole before any sensors can be installed. U.S. Pat. No. 5,206,840 describes one method for implanting geophones (seismic sensors) in wells using a pipe or drill string. In one method, the drill string is withdrawn from the well and an open-ended drill pipe is introduced into the borehole, through which the sensors can be installed. In another method, the drill bit is sheared from the end of the drill string and the sensors pumped into the borehole. While this avoids the need to withdraw the drill string, it does mean the loss of the drill bit for each borehole.

It has recently been proposed to conduct operations below a drill bit by using a special bit with a passageway allowing access to the borehole from the inside of the drill string. One type of such operation allows interaction with the borehole ahead of the bit, for example to introduce fluids, or drill pilot holes or the like. Examples of these techniques can be found in WO 03/008754, US 2004/0238218 and US 2004/0238224. Another type of similar operation is through bit logging as is described in WO 00/17488.

All of these known techniques suffer from problems if used to install permanent sensors. The system of U.S. Pat. No. 5,206,840 requires either the complete removal of the drill string prior to introduction of open-ended drill pipe, or shearing of the drill bit.

The though bit techniques described in WO 03/008754, US 2004/0238218, US 2004/0238224 and WO 00/17488 are all based on procedures in which the drill string remains in the borehole for further drilling operations, and for which all equipment is withdrawn from the well on completion of the activity.

It is an object of the invention to provide a method for installing sensors which does not suffer from these problems.

DISCLOSURE OF THE INVENTION

A first aspect of this invention provides a method of installing a sensor in a borehole drilled through underground formations, wherein the borehole is drilled with a hollow drill string formed from a series of pipe sections connected end-to-end, a drill bit being positioned at one end of the drill string and having a closure member that is operable to provide an opening between the borehole and the inside of the drill string, the method comprising:

- drilling the borehole to a predetermined depth using the drill string and bit;
- partially withdrawing the drill string from the borehole so that the drill bit is positioned above the predetermined depth;
- lowering a sensor inside the drill string by means of a cable;
- operating the closure so that the sensor can pass out of the drill string into the borehole; and
- progressively withdrawing the drill string and drill bit from the borehole over the cable so as to leave the sensor in the borehole.

The method preferably comprises securing the cable after the sensor has been lowered inside the drill string so that the sensor remains at substantially the same position in the borehole as the drill string is removed from the borehole. The cable can be cut to length prior to securing the cable.

The method typically comprises:

- clamping the cable at a point outside the drill string as the uppermost pipe section of the drill string is withdrawn from the well;
- disconnecting the uppermost pipe section from the remainder of the drill string, the cable extending through the uppermost pipe section and the remainder of the drill string;
- clamping the cable in the pipe section near the top of the remainder of the drill string and releasing it from the point outside the drill string; and
- withdrawing the cable from the disconnected pipe section, reconnecting it to at the point outside the drill string and releasing the cable from clamping in the pipe section near the top of the drill string.

The steps of clamping, disconnecting, clamping and withdrawing steps can be repeated until the drill string is entirely withdrawn from the borehole.

Cement can be pumped into the borehole through the drill string as it is withdrawn.

In one embodiment, the sensor comprises a number of separate sensor elements spaced along the cable. The sensor or sensors typically detect pressure, temperature and/or seismic data.

In another embodiment of the invention, the method comprises drilling multiple boreholes and installing sensors in each borehole is a predetermined region.

The position of the borehole and the predetermined depth can be selected so that the sensor is sensitive to activity in an offset borehole.

Further aspects of the invention will be apparent from the following description.

MODE(S) FOR CARRYING OUT THE INVENTION

Figure 3:
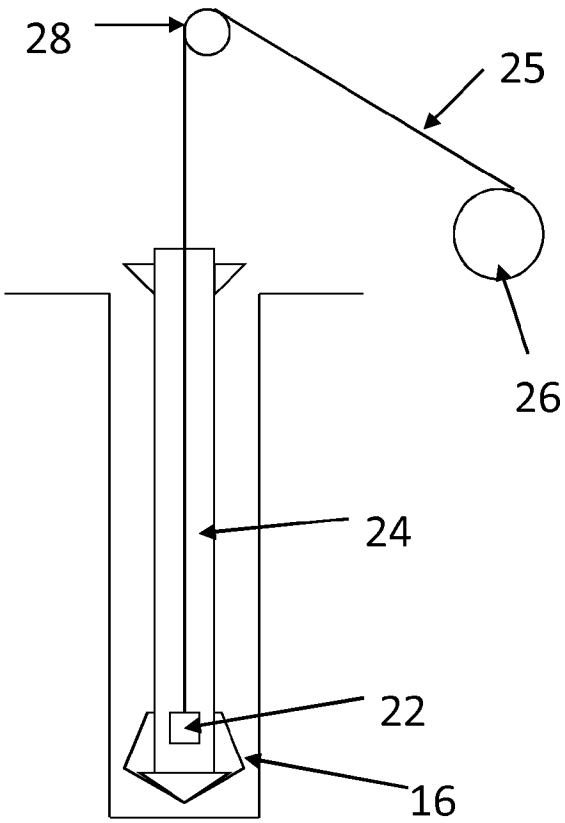
FIGS. 1-8 show the various stages of a method according to a first embodiment of the invention.

Referring now to FIGS. 1-8, the method of installing a sensor is based on drilling a borehole 10 through underground formations 12 from a rig (not shown) using a conventional drill string 14 having a drill bit 16 at its lower end. The drill pipe 14 is formed from a series of drill pipes (joints) connected in an end-to-end fashion by correspondingly threaded end portions. The drill bit 16 is of a known type in which a closure member 18 is provided at a central region of the bit, which can be opened to provide access to the borehole from inside the drill string (examples of such bits can be found in WO 00/17488, WO 03/008754, US 2004/0238224 and US 2004/0238218, and are used in known 'though bit logging' or 'TBL' systems). The drill string in this example is rotated using a top drive (not shown).

Figure 2:
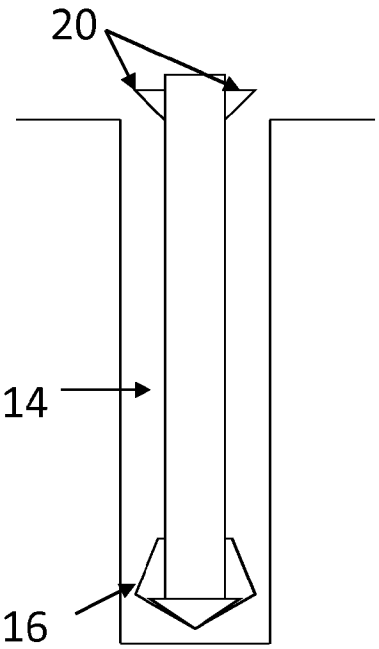
Figure 1:
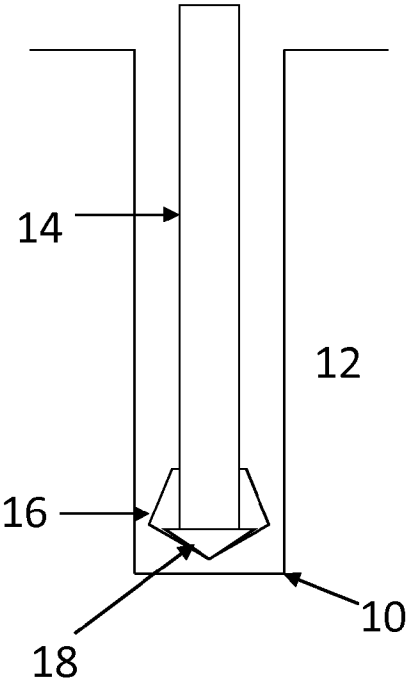

Drilling continues with such a system until a predetermined, target depth is reached (FIG. 1). At this point, the drill string is withdrawn to pick the bit 16 off bottom and the drill string 14 supported at the surface in slips 20 (FIG. 2). The top drive can then be disconnected and a sensor 22 lowered into the drill string 14 on a cable 24 that is lead from a conventional winch arrangement 26, over a sheave 28 and into the interior of the drill string (FIG. 3). The sensor 22 is lowered until it is positioned just above the bit 16 inside the drill string 14. At this point, the cable 24 can be cut so as to leave a relatively short 'tail' 25 at the surface above the top of the drill string 14. For example, when using conventional 30 ft pipe joints for the drill string 14, a tail of about 100 ft may be appropriate.

Figure 4:
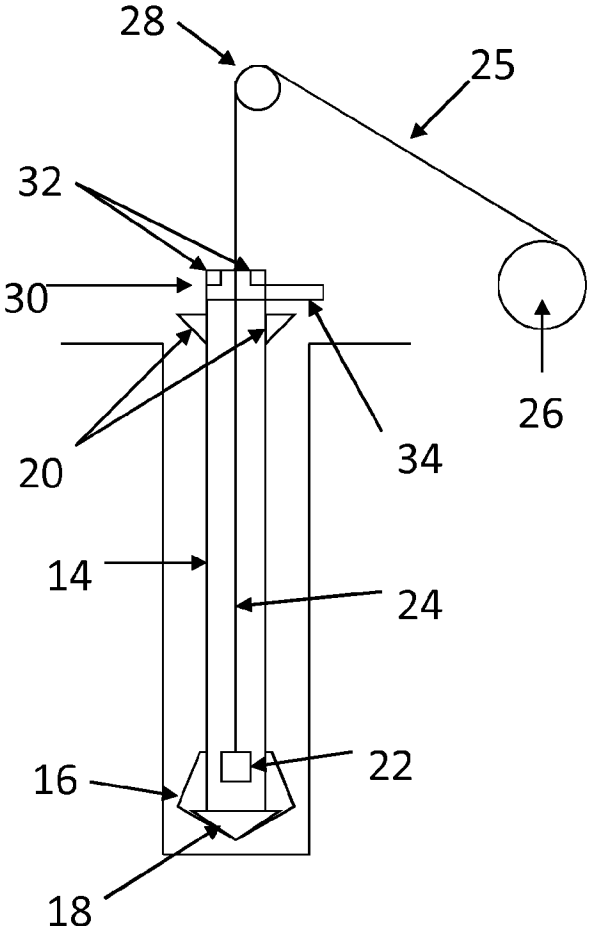

The tail 25 can then be threaded through a packoff in an injector head 30 which can then be screwed to the top of the drill string 14. The packoff can have a seal arrangement 32 for clamping onto the cable 24 and a side outlet 34 is provided below the seal 32 for providing fluid communication with the inside of the drill string 14 (FIG. 4).

The cable tail 25 is lead over the sheave 28 which is typically positioned about 1.25 time the length of a joint of drill pipe above the rig floor (not shown). The cable 25 is held on the winch 26 or otherwise clamped on the rig floor. The clamping arrangement 32 is open and fluid is pumped into the drill string 14 under the injector head 30 through the outlet 34 until the closure member 18 is pumped out of the bit 16. The injector head 30 is then unscrewed from the drill string 14 and the cable 24 clamped to the tope of the drill string 14. The tail 25 is then unthreaded from the injector head 30 and lead back over the sheave 28 to the winch 26 and then unclamped from the drill string 14.

Figure 5:
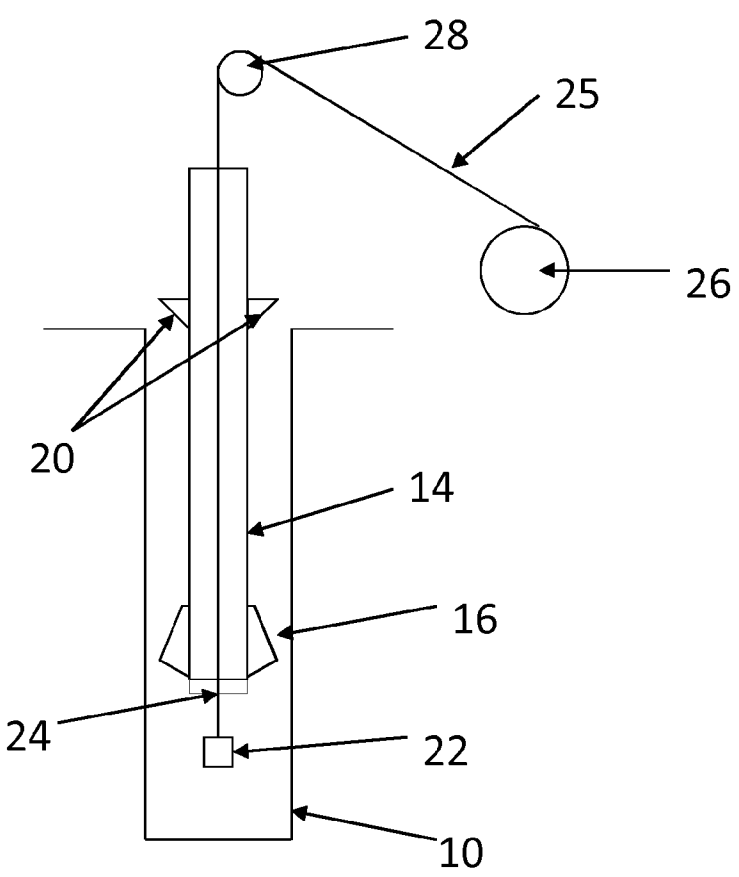

Elevators (not shown) can then be engaged on top of the drill string 14 and used to raise the drill string 14 by one joint and then reset it back on the slips 20. Because the closure member 18 has been removed from the bit 16, and the cable 24 is not engaged with the drill string 14, the sensor 22 remains substantially in the same place in the borehole 10 (FIG. 5).

Figure 7:
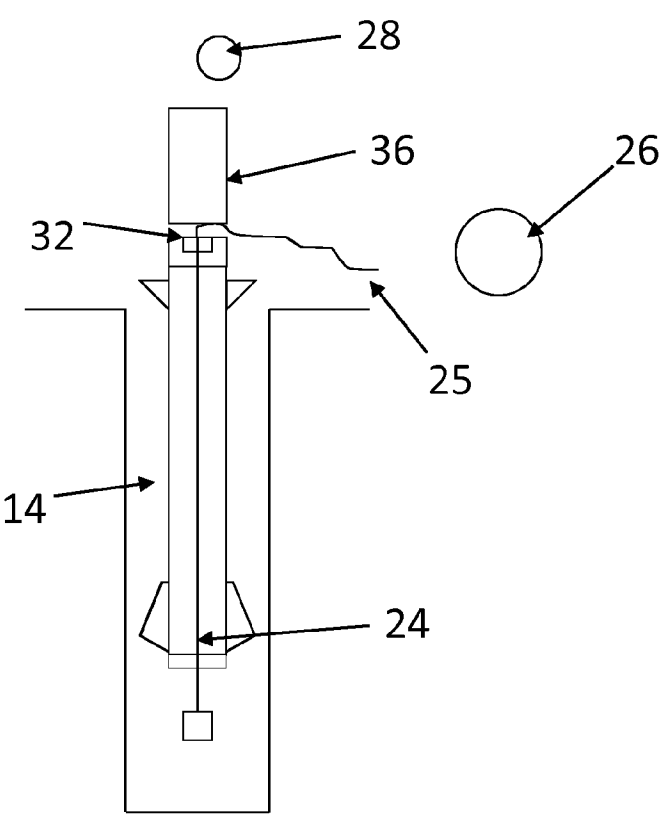
Figure 6:
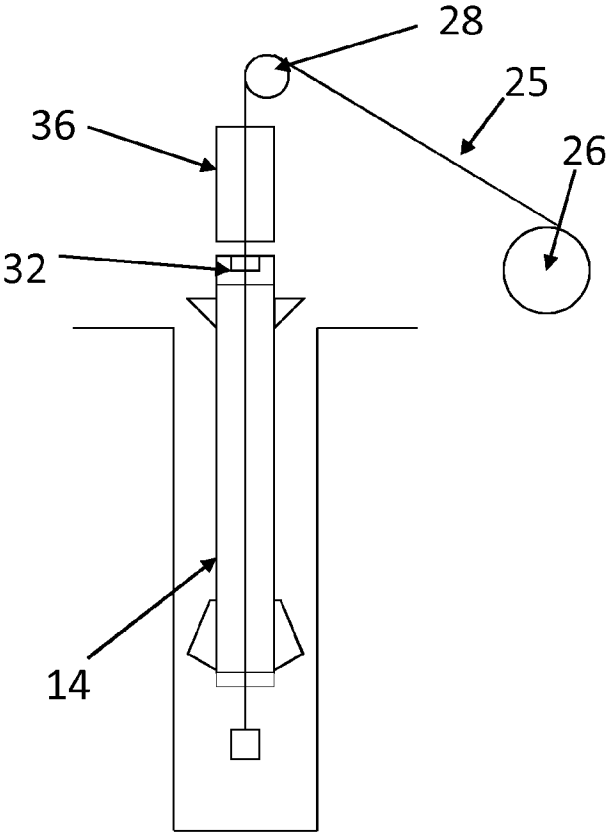
Figure 8:
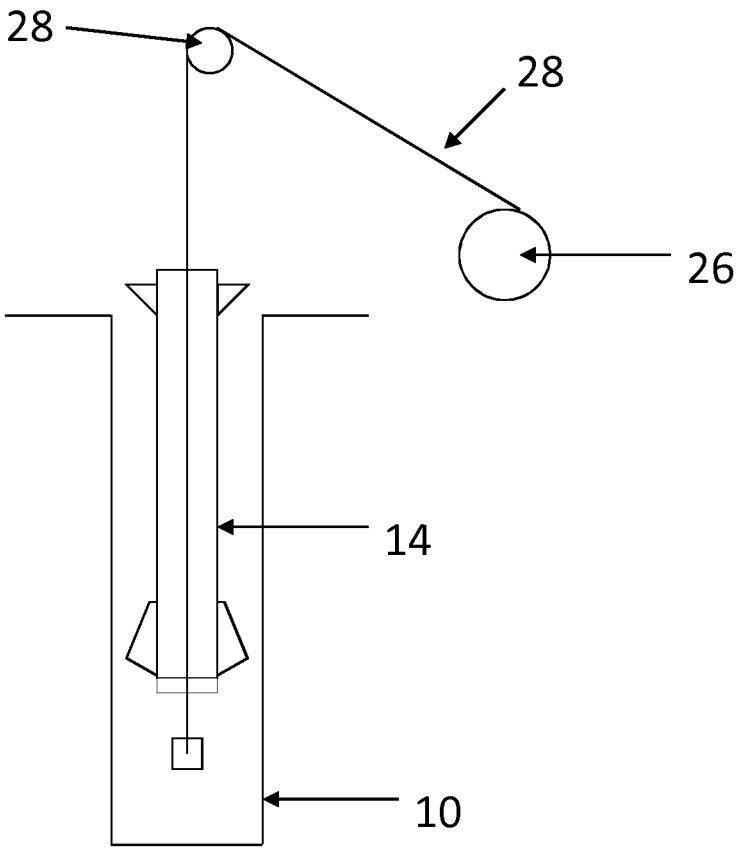
Figure 10:
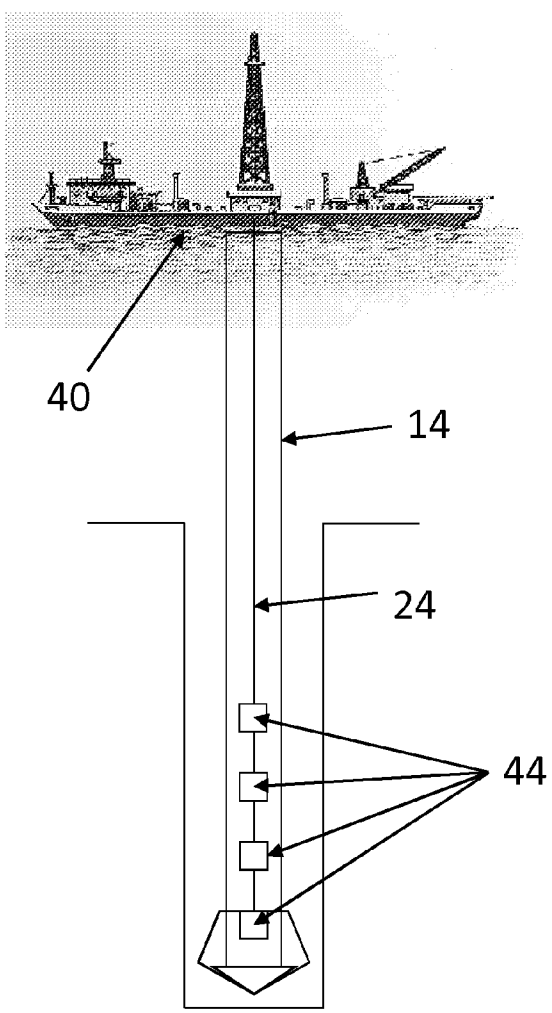
FIGS. 9-13 show the various stages of a method according to a second embodiment of the invention.
Figure 9:
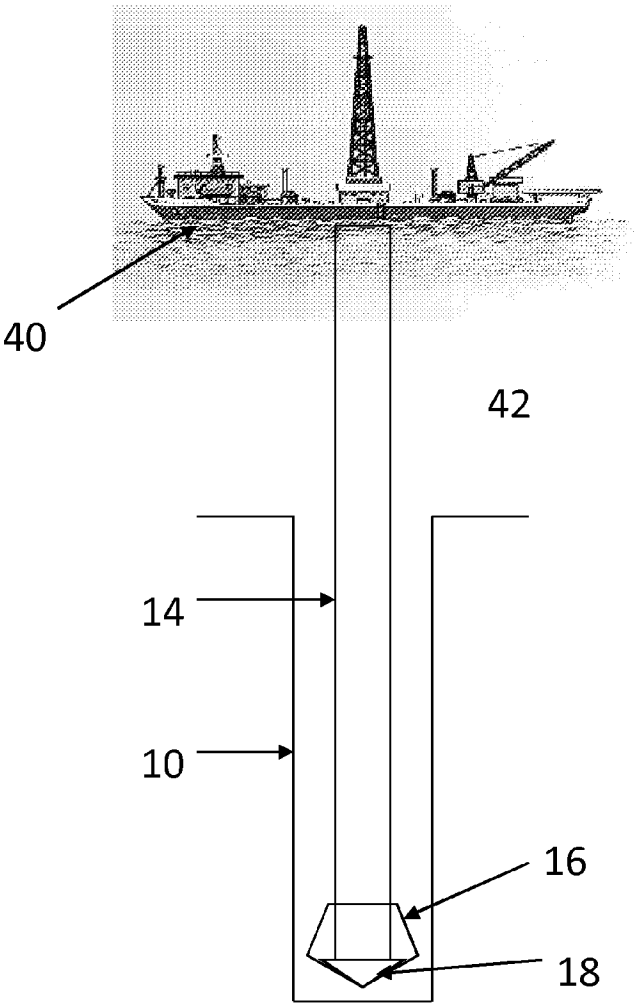
Figure 12:
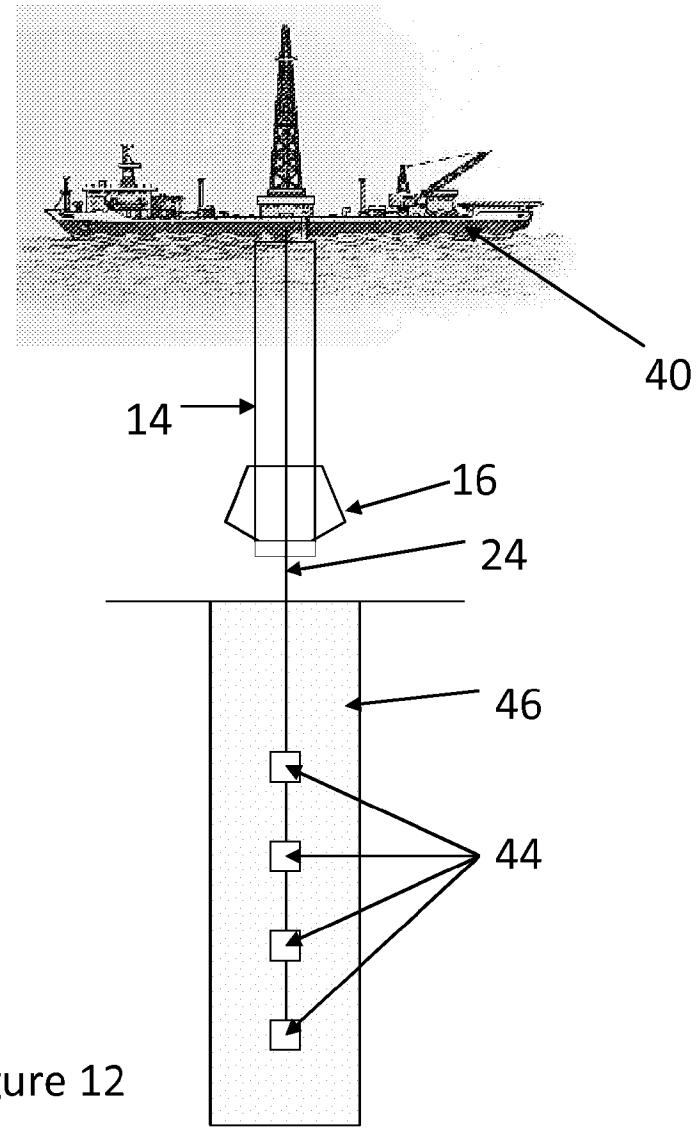

The top joint 36 is then disconnected from the rest of the drill string 14 and the clamping system 32 reinstalled on the top of the drill string 14 (FIG. 6). The clamp 32 is then operated to hold the cable 24 and the tail 25 is disconnected from the winch 26 and sheave 28 and pulled through the joint 36 which can then be removed (FIG. 7). The tail 25 can then be rethreaded over the sheave 28 and reattached to the winch 26, and the clamp released and removed (FIG. 8). The steps described above in relation to FIGS. 5-8 can then be repeated until all of the drill string and the bit are removed from the borehole.

In its simplest form, the method includes leaving the borehole without any further modification, typically filled with the fluid used for drilling. For a more permanent installation, cement can be pumped into the borehole as the drill string is removed as will be described in more detail below.

Figure 11:
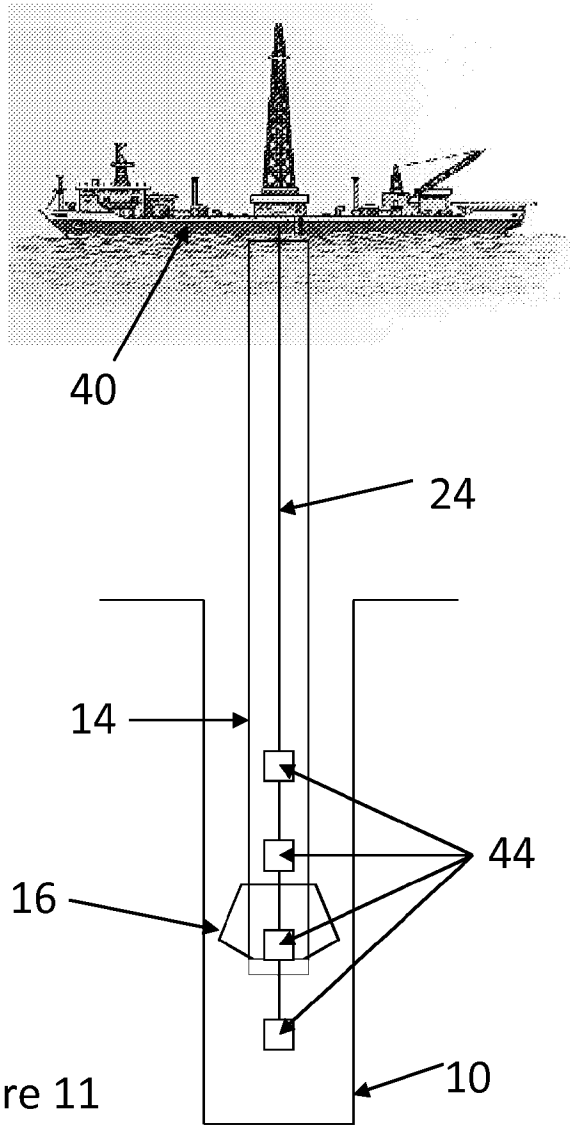

FIGS. 9-13 show another embodiment of the method according to the invention, this time performed under water from a floating rig such as a drill ship. In this case, the drill floor is located on a drill ship 40 and the drill string 14 extends through the sea 42 before entering the borehole 10. The apparatus within the borehole 10 is essentially as decried in relation to FIG. 1. At the point corresponding to FIG. 3 above, a series of sensors (sondes) and a pumpout tool 44 are run into the drill string 14 on the cable 24. The pumpout tool is then operated to remove the closure member 18 rather than pumping from the surface. The steps described above in relation to FIGS. 5-8 are then repeated to withdraw the drill string 14 from the borehole 10 (FIG. 11). As the drill string 14 is withdrawn from the borehole 10, cement is pumped into the borehole 10 to seal the sondes 44 in place and stabilise the borehole 10. Once the drill bit 16 leaves the borehole 10, no further cement is pumped and the operation continues (FIG. 12) until the drill bit 16 reaches the drill ship 40, leaving the borehole 10 filled with cement 46. Where the sondes 44 comprise seismic or micro-seismic sensors, the cement 46 is selected so as to have essentially the same acoustic impedance and the surrounding rock to improve acoustic coupling.

Figure 13:
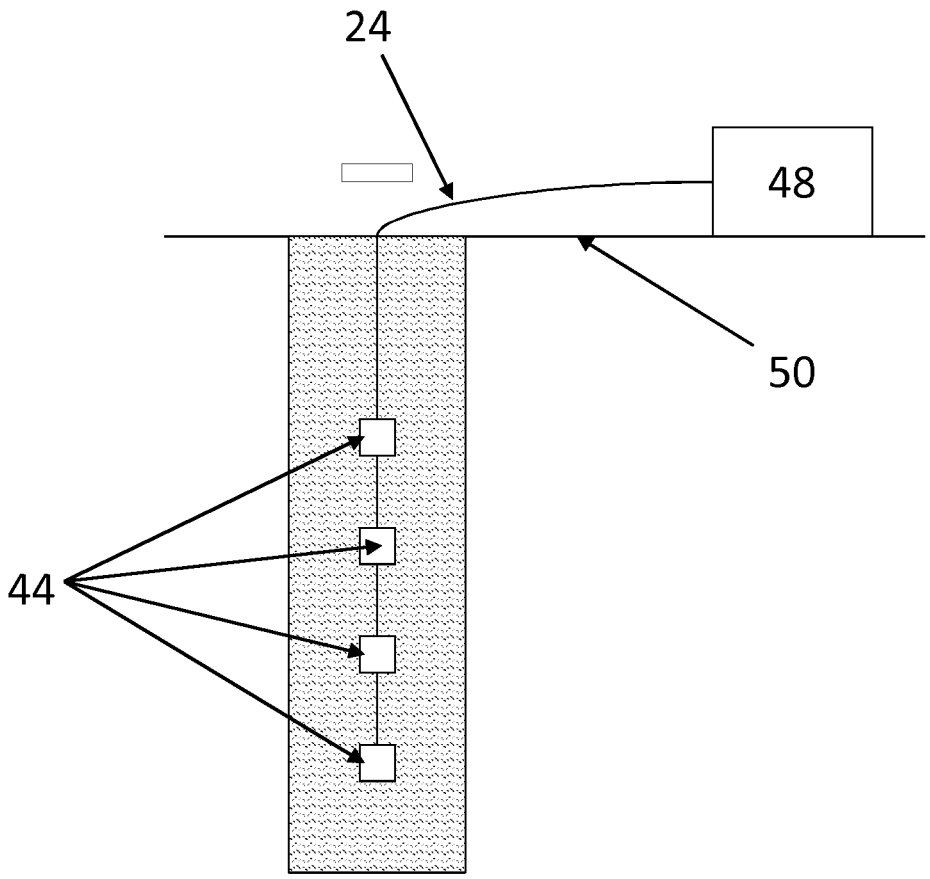

Once the drill string has been recovered, the end of the cable 24 can be attached to a control box 48 which can be lowered to the sea bed 50 (FIG. 13). The control box 48 collects data from the sondes 44 and can have one of a number of different forms. For example, it can be a connector to a hard wired system on the sea bed; a memory device which can be accessed by an ROV or the like, and electronic to acoustic converter to send data to surface, etc. Alternatively the end of the cable can be attached to a cable network already laid on the seabed to collect information and/or deliver power to subsea installations. In another embodiment the end of the cable can be attached to a floating or fixed structure at the surface.

As will be appreciated from the above description, the number and nature of the sensors or sondes depend on the particular data to be acquired. In some cases, a single sensor may be applicable; in others arrays of sensors for the same or different parameters may be used. Additional devices may also be located on the cable. For example a data storage device i.e. a data collecting, data recording, and/or data transmitting device may be located above an array of sensors on the cable. Where a data collection device is installed on the cable, the device is located on the cable so as to be in positioned near the seabed when the drill string is withdrawn from the borehole. The data collection device may have a remotely activated wire line connection to the cable that may be activated by any of mechanical, electrical or electromagnetic methods. Once the drill bit is above the data collection device, the connection is released and the data collecting device can fall to the sea bed or into the drilled borehole. Information gathered from the sensors is transmitted to the data collection device which can send the data to the surface for example by an acoustic, electromagnetic signal or by a hard wire system.

Figure 14:
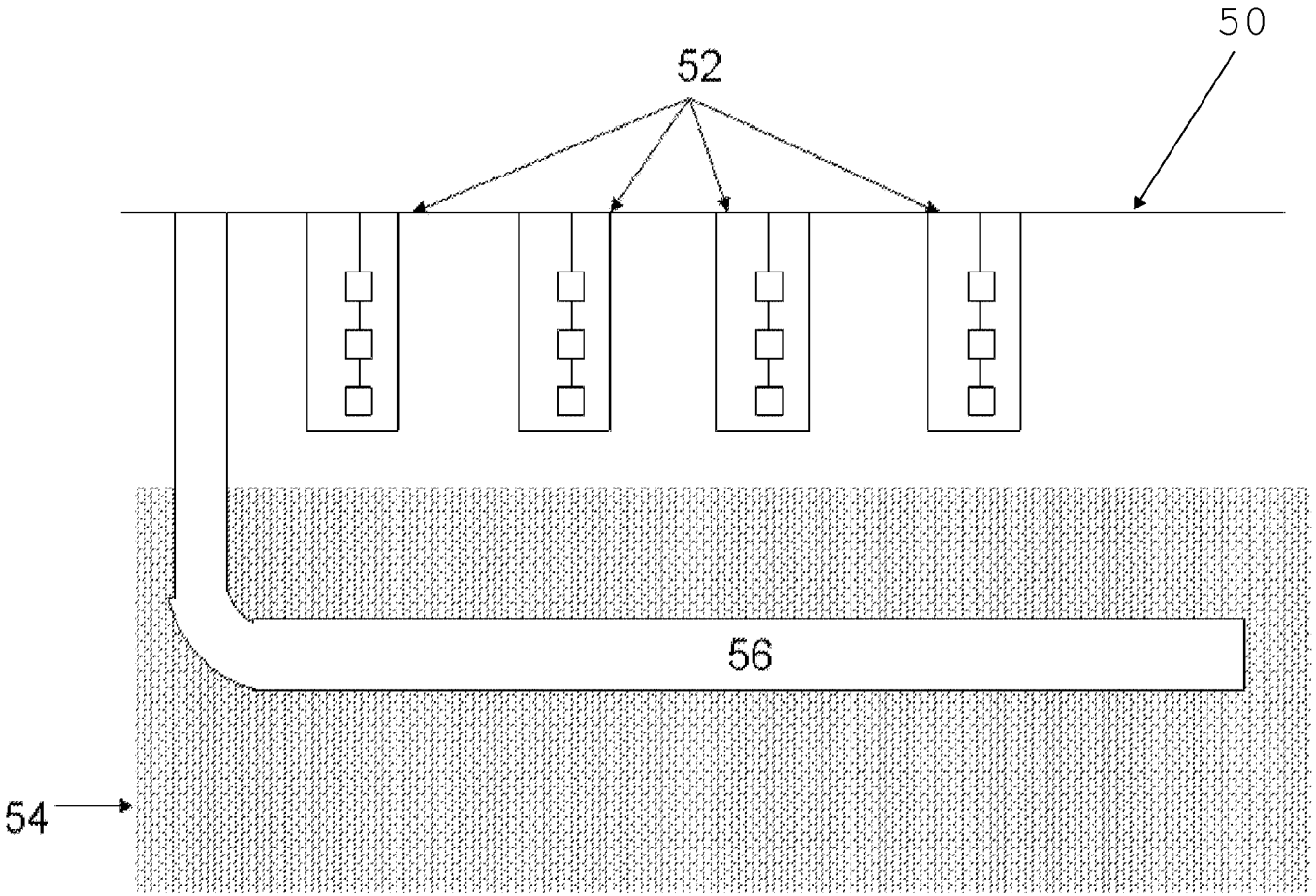
FIG. 14 shows one specific application of a method according to the invention.

Also, the number of boreholes drilled in a region can be selected according to requirements. FIG. 14 shows one embodiment of an installation according to the invention. A series of instrumented boreholes 52 are drilled in the sea bed 50 above a pay zone 54 through which a horizontal production or injection well 56 extends. The sensors in the boreholes 52 can include pressure sensors, temperature sensors (e.g. distributed temperature sensors based on fibre optic technology), fluid resistivity sensors, electromagnetic wave sensors, radioactivity sensors, seismic, or micro-seismic sensors and can be used to monitor the pay zone 54 as production or injection takes place.

Further changes within the scope of the invention will be apparent.

The invention claimed is:

1. A method of installing a sensor in a borehole comprising:

positioning a drill string in the borehole, wherein the drill string comprises a closure member operable to provide an opening between the borehole and the inside of the drill string;

lowering a sensor inside the drill string by means of a cable;

operating the closure member so that the sensor can pass out of the drill string into the borehole while maintaining the drill bit connected with the drill string; and progressively withdrawing the drill string and drill bit from the borehole over the cable so as to leave the sensor in the borehole in substantially the same position in the borehole as the drill string and drill bit are withdrawn from the borehole.

2. A method as claimed in claim 1, comprising securing the cable after the sensor has been lowered inside the drill string so that the sensor remains at substantially the same position in the borehole as the drill string is removed from the borehole.

3. A method as claimed in claim 2, further comprising cutting the cable to length prior to operating the closure member.

4. A method as claimed in claim 2, comprising:

clamping the cable at a point outside the drill string as an uppermost pipe section of the drill string is withdrawn from the borehole;

disconnecting the uppermost pipe section from the remainder of the drill string, the cable extending through the uppermost pipe section and the remainder of the drill string;

clamping the cable in the pipe section near the top of the remainder of the drill string and releasing it from the point outside the drill string; and withdrawing the cable from the disconnected pipe section, reconnecting it to at the point outside the drill string and releasing the cable from clamping in the pipe section near the top of the drill string.

5. A method as claimed in claim 4, comprising repeating the clamping, disconnecting, clamping and withdrawing steps until the drill string is entirely withdrawn from the borehole.

6. A method as claimed in claim 4, wherein the borehole is a subsea borehole and the cable is reconnected to a cable laid on the sea bed.

7. A method as claimed in claim 4, wherein the borehole is a subsea borehole and the cable is reconnected to a structure on the surface.

8. A method as claimed in claim 1 wherein the borehole is a subsea borehole and the cable comprises a data storage device located above the sensor.

9. A method as claimed in claim 1, further comprising pumping cement into the borehole through the drill string as it is withdrawn.

10. A method as claimed in claim 1, wherein the sensor comprises a number of separate sensor elements spaced along the cable.

11. A method as claimed in claim 10, comprising drilling multiple boreholes and installing sensors in each borehole in a predetermined region.

12. A method as claimed in claim 1, wherein the position of the borehole and a predetermined depth are selected so that the sensor is sensitive to activity in an offset borehole.

13. A method as claimed in claim 1, wherein the sensor detects at least one of pressure, temperature, fluid resistivity, seismic waves, electromagnetic waves, and radioactive activity.

14. A method as claimed in claim 1, wherein the sensor can emit at least one of electromagnetic waves, sonic waves and radioactive waves.

15. A method of installing a sensor in a borehole, the method comprising:

deploying the sensor on a cable through a drill string that has a drill bit located at a terminal end thereof, wherein the drill string is located in the borehole;

operating a closure member on the drill string to allow the sensor to pass out of the drill string into the borehole while the drill bit remains connected with the drill string; and progressively withdrawing the drill string and drill bit from the borehole over the cable so as to leave the sensor in the borehole in substantially the same position in the borehole as the drill string and drill bit are withdrawn from the borehole.

16. The method of claim 15, further comprising:

pumping cement into the borehole through the drill string as it is withdrawn to install the sensor in the borehole.

* * * * *